US006062490A

United States Patent [19]

Katzer et al.

[11] Patent Number: 6,062,490

[45] Date of Patent: May 16, 2000

[54] METHOD FOR ADJUSTING THE SPRINKLING PATTERN OF A SPRINKLING APPARATUS AND SPRINKLING APPARATUS

[75] Inventors: Johann Katzer, Neu-Ulm; Wolfgang Lindermeir, Untermarchtal, both of Germany

[73] Assignee: Gardena Kress +Kastner GmbH, Ulm, Germany

[21] Appl. No.: 09/168,006

[22] Filed: Oct. 7, 1998

[30] Foreign Application Priority Data

Jul. 10, 1998 [DE] Germany ..... 198 30 860

[51] Int. Cl.[7] ..... B05B 3/00

[52] U.S. Cl. ..... 239/246; 239/562; 239/DIG. 1; 251/4

[58] Field of Search ..... 239/1, 240, 242, 239/246–248, 548, 551, 553, 562, 566, 567, 546, 451, 455, 581.1, 602, DIG. 1, DIG. 12; 251/4, 7

[56] References Cited

U.S. PATENT DOCUMENTS

| | | | |
|---|---|---|---|
| 3,244,373 | 4/1966 | Hait . | |
| 3,423,024 | 1/1969 | Morawetz | 239/242 |
| 4,932,629 | 6/1990 | Rodomista et al. | 251/4 |
| 5,350,115 | 9/1994 | Burnworth et al. | 239/242 |
| 5,628,458 | 5/1997 | Kuo | 239/242 |
| 5,657,928 | 8/1997 | Jian | 239/242 |

FOREIGN PATENT DOCUMENTS

| | | |
|---|---|---|
| 00 47 444 A1 | 8/1981 | European Pat. Off. . |
| 0 713 426 B1 | 8/1994 | European Pat. Off. . |
| 885 173 | 8/1953 | Germany . |
| 1 926 735 | 5/1969 | Germany . |
| 31 19 094 A1 | 11/1982 | Germany . |
| 38 33 983 A1 | 4/1990 | Germany . |

*Primary Examiner*—James Hook
*Assistant Examiner*—Lisa Ann Douglas
*Attorney, Agent, or Firm*—Herbert Dubno

[57] ABSTRACT

A sprinkling apparatus constructed as a square sprinkler has a nozzle arrangement with a straight row of nozzles, whereof each has a nozzle inlet connected by a nozzle duct to a nozzle outlet. At least in a portion between the nozzle inlet and nozzle outlet, the nozzles are constructed as rubber-like water guidance ducts, which are disconnectable by a force action transversely to the water flow direction. For the disconnection of individual nozzles clamping sliders are provided and are displaceable transversely to the water flow direction against the rubber-like nozzles and in the case of a displacement in each case disconnect or release again a nozzle. This permits a very variable adjustment of the sprinkling pattern.

41 Claims, 3 Drawing Sheets

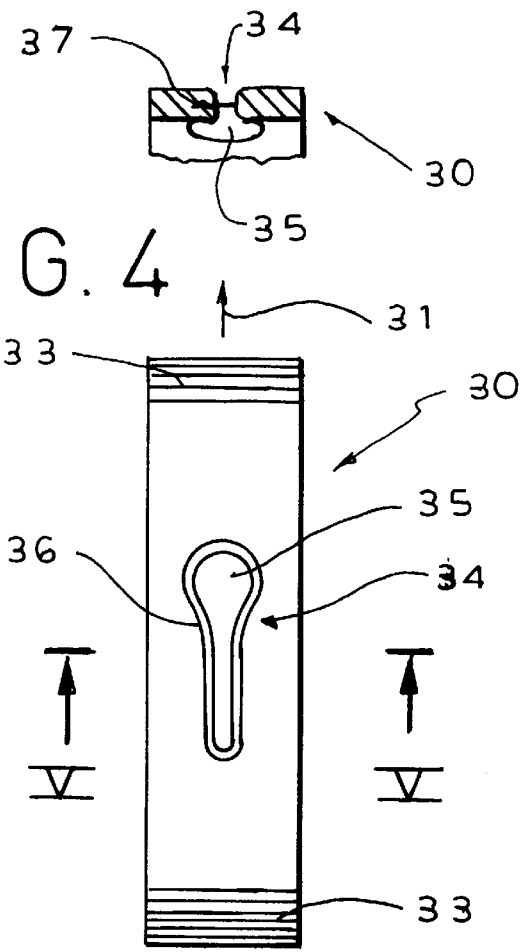
FIG. 4
FIG. 5
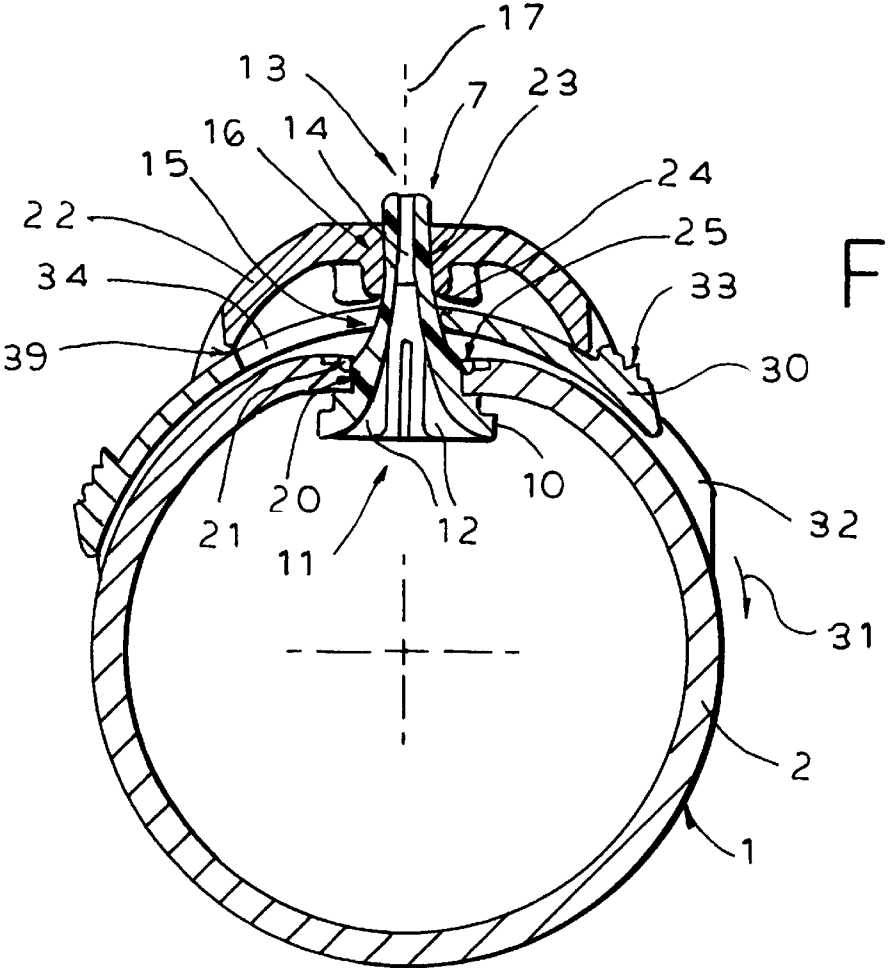
FIG. 3

METHOD FOR ADJUSTING THE SPRINKLING PATTERN OF A SPRINKLING APPARATUS AND SPRINKLING APPARATUS

FIELD OF THE INVENTION

The invention relates to a method for adjusting the sprinkler or sprinkling pattern of a sprinkling apparatus, particularly a square sprinkler. The invention also relates to a sprinkling apparatus.

BACKGROUND OF THE INVENTION

Sprinkling apparatuses are mainly used in the horticultural field for the surface-covering water supply of plants, but can also be used for dampening other surfaces, such as sand tennis courts and the like, which are to be kept moist. A sprinkling apparatus is normally set up in fixed manner, connected to a water supply and produces a sprinkling pattern, which determines the shape and size of the sprinkled surface area, as well as the sprinkling density. It is desirable for a variable use of such sprinkling apparatuses to be able to adjust the sprinkling pattern, in order to adapt the sprinkling apparatus to the intended use.

Such sprinkling apparatuses have a nozzle arrangement with a plurality of nozzles connectable to a liquid supply and in particular a water supply. Each nozzle has a nozzle inlet facing the liquid supply and connected by means of a nozzle duct to a nozzle outlet spaced from the nozzle inlet. A nozzle arrangement is a monodimensional or multidimensional array of nozzles with substantially fixed, predetermined, relative positions. A predeterminable sprinkling area must be dampened, it is appropriate to avoid spray formation with respect to the nozzles, because fine water particles can easily be blown away by the wind. Thus, a nozzle is preferably constructed as a single jet nozzle for delivering a bundled liquid jet.

For adjusting the sprinkling pattern of so-called square sprinklers with a plurality of separate nozzles, it is known either to separate the nozzle inlets from the liquid supply or to seal the nozzle outlets, it being possible for the sealing measures to cover individual nozzles or also nozzle groups.

In a square sprinkler described in German patent 1 926 735, in the interior of a nozzle box is mounted in rotary manner a sleeve with different openings by means of which it is possible to block or free in groupwise manner the nozzle inlets provided on the nozzle box. The arrangement of a sealing mechanism in the interior of the nozzle box is constructionally complicated. Only a limited number of different sprinkling patterns can be set and are predetermined by the distribution of the openings in the sleeve.

In a square sprinkler known from European patent 713 426, the interior of a nozzle box is provided with an arrangement with camshaft and tilting levers in each case associated with the nozzles. By means of the camshaft the tilting levers are moved in such a way that individual nozzle inlets are blocked/sealed or freed. Here again, an adjustment is only possible within the scope of the predetermined camshaft design. The blocking mechanism is complicated and correspondingly fault-prone.

In the square sprinkler described in DE 31 19 094, a slider is displaceable in the longitudinal direction of the nozzle box in the interior thereof, so that the nozzles can be successively shut down from one side. The adjustment possibilities of this square sprinkler are very limited.

In the square sprinkler known from U.S. Pat. No. 3,423, 024, individual nozzles can be shut down by covering the nozzle outlets. Covering is brought about by annular covering elements, which are snapped onto the outside of the tubular nozzle box and, when necessary, are shoved over the particular nozzle outlet to be closed. Particularly in the case of lime-containing water, sealing problems can arise in this square sprinkler which impair the adjustability of the sprinkling pattern.

The problem of the invention is to obviate the disadvantages of the prior art. In particular, a permanently operationally reliable sprinkling apparatus is to be provided permitting a variable setting of the sprinkling pattern.

SUMMARY OF THE INVENTION

The invention of the invention serves for adjusting a sprinkling pattern of a sprinkling apparatus having a nozzle arrangement which is connectable to a supply for liquid and has a plurality of nozzles. Each nozzle has a nozzle inlet, which is connected by means of a nozzle duct to a nozzle outlet and wherein a nozzle has a nozzle duct cross-section and at least one nozzle has a cross-section change portion. For adjusting the sprinkling pattern the liquid flow through at least one nozzle is influenced by modifying the nozzle duct cross-section of the nozzle in at least one cross-section change portion.

The sprinkling apparatus comprises at least one nozzle arrangement connectable to a supply for liquid, the nozzle arrangement having a plurality of nozzles, wherein each nozzle has a nozzle inlet, which is connected by means of a nozzle duct to a nozzle outlet and;

an adjusting device for selectively setting the liquid delivery of one of individual nozzles and nozzle groups of the nozzle arrangement, wherein at least one nozzle has at least one cross-section change portion, in which the nozzle duct cross-section is variable and wherein the adjusting device comprises cross-section change means acting on the cross-section change portion.

In the method according to the invention, for adjusting the sprinkling pattern for at least one nozzle, the liquid flow through the nozzle is influenced, in that a nozzle duct cross-section is modified in at least one cross-section change portion. Whereas in the prior art external closing devices are provided for the nozzle inlet or nozzle outlet of an intrinsically unchanged nozzle with invariable nozzle duct geometry, according to the invention changes are made to the nozzle in the vicinity of its nozzle duct, which influence the liquid flow through the nozzle. This obviates the need for optionally design-complicated, external sealing devices. In addition, it is possible to avoid sealing problems, which in particular arise with lime-containing water if, in the vicinity of the nozzle inlets, but in particular the nozzle outlets linked with the ambient air, lime deposits form, which make difficult or prevent a complete sealing of a nozzle opening and possibly make necessary at certain time intervals a deliming of the sprinkling apparatus.

Although it is possible to modify the nozzle duct cross-section in the vicinity of the nozzle outlet and/or the nozzle inlet, it is preferable for the cross-section change portion to be located substantially centrally between the nozzle inlet and nozzle outlet and correspondingly for the cross-section change to take place in the intermediate area between nozzle inlet and outlet. Preferably the nozzle duct cross-section in the vicinity of the nozzle inlet and/or nozzle outlet remains substantially unchanged, so that both for the inflow of liquid and for the outflow or delivery there are unchanged geometrical conditions at the nozzle. Thus, the nozzle inlet and outlet can be designed for optimum liquid guidance, without the design being influenced by the adjustment process.

The nozzle duct cross-section can be changed in stages, i.e. increased or decreased. Preferably, the change takes place gradually or continuously, so that the intensity of the liquid flow through a nozzle can be sensitively adjusted. The situation is normally such that the nozzle duct cross-section is reduced up to a liquid-tight blocking of the nozzle duct or increased up to the largest passage cross-section predetermined by the nozzle geometry.

For modifying the nozzle duct cross-section, it is possible to provide closing or blocking members such as sliders or the like, which can be introduced through lateral openings of the nozzle duct into the same. It is preferable if the cross-section change portion, which can in particular be bounded by an elastic, flexible wall, is compressed during the adjustment by force action transversely to the nozzle duct and accompanied by a reduction of the cross-section or widens accompanied by cross-sectional enlargement. A preferably provided, liquid-tight, flexible wall, at least in the cross-section change portion provides a liquid-tight nozzle duct, which is only open on the inlet and outlet side and in which there are also no lateral liquid losses under increased liquid pressure. It is preferable if the cross-section change portion, during the adjustment, is compressed symmetrically to the nozzle duct, particularly from two diametrically facing directions with respect to the nozzle duct and preferably perpendicular to the longitudinal direction of the nozzle duct. A symmetrical compression leads to a uniform distribution of the mechanical load on the wall of the cross-section change portion.

A sprinkling apparatus particularly suitable for performing the method has at least one nozzle arrangement of the described type connectable to a liquid supply and an adjusting device for the, as desired, setting of the liquid delivery of individual nozzles or nozzle groups of the nozzle arrangement. It is characterized in that at least one nozzle has at least one cross-section change portion, in which the nozzle duct cross-section can be modified, and that the adjusting device has cross-section change means acting on the cross-section change portion. Normally, several or all the nozzles of the nozzle arrangement have one or more such cross-section change portions.

In the case of the nozzle arrangement, the nozzles preferably constructed as single jet nozzles, are preferably arranged in a regularly distributed manner and preferably adjacent nozzles are substantially equidistantly spaced. Preferably the nozzle arrangement is a single, particularly linear nozzle row. It is also possible for the nozzles to be in a two-dimensional, preferably planar field or array, e.g. a double or multiple row, or in a three-dimensional arrangement. The nozzle arrangement is movable as a whole, preferably movable in periodic reciprocating manner, e.g. about a reciprocating axis parallel to a nozzle row.

The cross-section change portion of a nozzle is preferably positioned between the nozzle inlet and the nozzle outlet, particularly roughly centrally between the inlet and outlet. This makes it possible to leave the nozzle unchanged in the inlet and outlet areas with respect to the position and/or shape, also during adjustment, so that there is no change to the jet direction during adjustment and instead only the jet intensity is modified.

In order to maintain stable the nozzle inlets, a first holding or retaining device with inlet through openings, e.g. formed by a liquid supply casing of the apparatus can be provided. A second holding or retaining device spaced therefrom and which can in particular be formed by a ledge-like holder, can receive the nozzle outlets in stable manner in outlet passage openings. Between the holding devices, preferably detachably fixable to one another, can be held and optionally guided the cross-section change means, particularly the clamping sliders. Such constructions can be easily assembled and are very reliable in operation.

A nozzle, at least in the vicinity of the cross-section change portion, can have a wall of elastic, flexible material, which at least partly and preferably completely embraces the nozzle duct, which can be compressed by force action from the outside, preferably transversely and in particular at right angles to the nozzle duct and as a result of its elasticity, is automatically reset without separate return means, when the external force action is removed.

On one or both sides of the compressible cross-section change portion the nozzle can be substantially rigid and/or optionally can be made from a different material from that in the cross-section change portion. A particularly appropriate, simple construction is obtained if a nozzle has a preferably one-piece nozzle body of an elastically flexible, particularly rubber-like material, on which are formed the nozzle inlet, nozzle outlet, nozzle duct and cross-section change portion.

Although it is possible to provide a separate, elastic nozzle body for each nozzle, it is preferable if the nozzle arrangement has at least one continuous, preferably strip-like nozzle arrangement body of elastically flexible material, on which are provided several, preferably all the nozzles of the nozzle arrangement, preferably in one piece. The nozzle strip preferably forming a nozzle row can be inserted in sealed manner in an e.g. tubular casing body of the liquid supply in such a way that the nozzle adaptors project outwards through corresponding wall openings of the casing. On the outwardly projecting portions can act the cross-section change means. A preferred shaping of the nozzles will be described in conjunction with an embodiment shown in the drawings.

The cross-section change means of a preferred embodiment comprise at least one disconnecting or squeezing device for disconnecting or squeezing a cross-section change portion of a nozzle compressible accompanied by a cross-sectional reduction. A disconnection can e.g. be brought about by gripper-like or screw-like actuating elements or by rotating an elastic nozzle about its axis. In a preferred embodiment, a disconnecting or squeezing device for a nozzle has at least one clamping slider, preferably displaceable in a clamping direction at right angles to the nozzle duct. It can e.g. press the cross-section change portion against a fixed stop and consequently disconnect or untie it. Preferably a clamping slider has a clamping opening enclosing the associated cross-section change portion and through which projects the nozzle body and whose internal diameter changes parallel to the clamping direction in such a way that during the movement of the slider in the clamping direction the cross-sectional change portion can be compressed, preferably from two diametrically facing sides.

If, for each of the adjustable nozzles, a separate, preferably manually operable cross-section change means, particularly a clamping slider is provided, it is possible to individually select nozzles for disconnection or release, so that to a significant extent the sprinkling pattern can be individually adjusted by the user. It is also possible to combine individual nozzles by a common cross-section change means to form an adjustable nozzle group. In particular, clamping sliders can be so displaceably positioned perpendicular to the nozzle row, that also for closely adjacent nozzles or nozzle groups an individual setting is possible.

All the nozzles need not be adjustable and instead e.g. only marginal nozzles or nozzle groups of a nozzle row are adjustable. For example, by disconnecting marginal nozzles, it is possible to reduce the sprinkled surface area. By disconnecting individual nozzles in spaced positions, it is possible to thin out the surface sprinkling. If only the reduction of the sprinkled surface is important, it is possible to provide cross-section change means, particularly disconnecting means, solely on the marginal nozzles or nozzle groups.

BRIEF DESCRIPTION OF THE DRAWINGS

An embodiment of the invention is shown in the drawings and is described in greater detail hereinafter relative to the drawings, wherein show:

FIG. 3 is a cross-section through a sprinkling apparatus perpendicular to the longitudinal axis of the sprinkler casing;

FIG. 4 is a plan view of a clamping slider of an embodiment of the invention;

FIG. 5 is a section through a clamping slider along line V—V in FIG. 4.

DETAILED DESCRIPTION OF EMBODIMENTS

Figure 1:
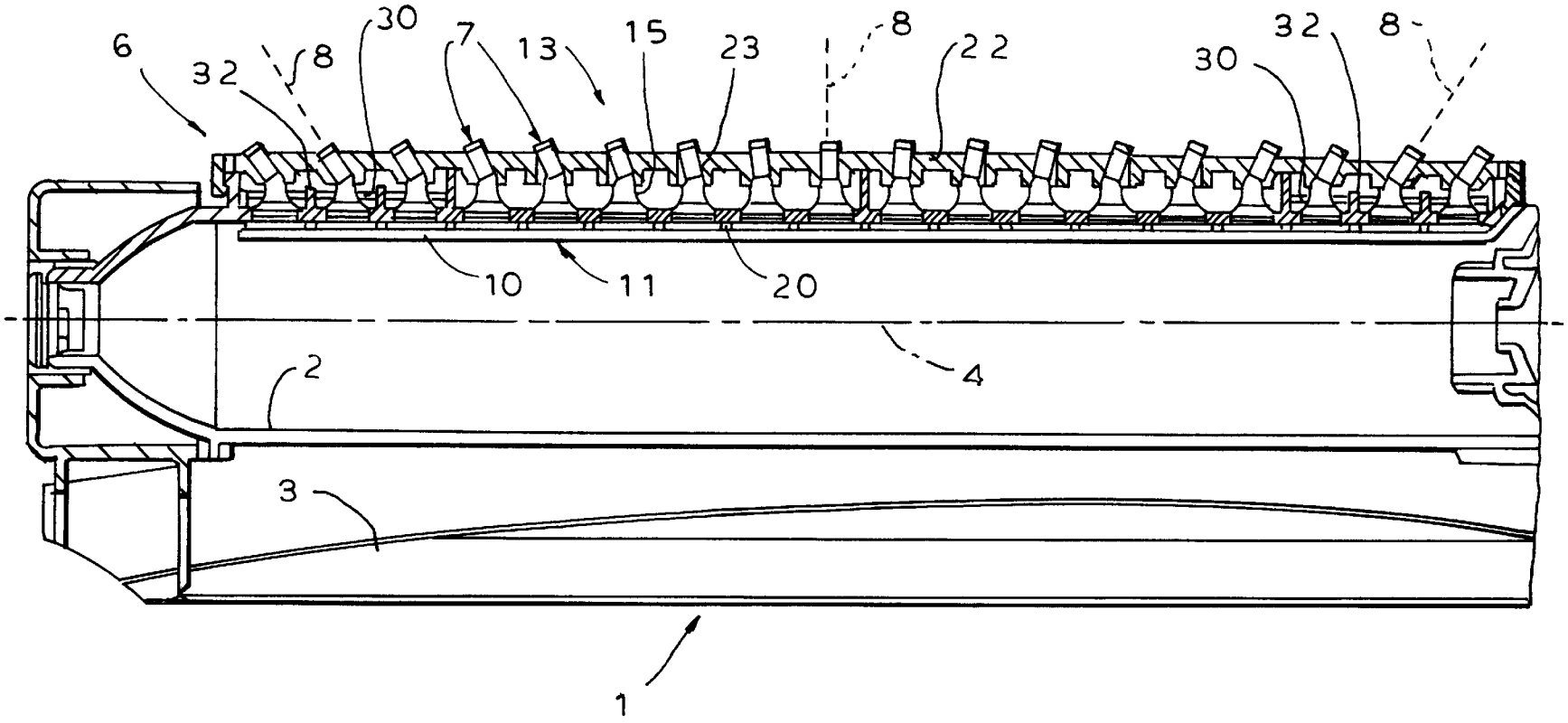
FIG. 1 is a longitudinal section in a vertical plane through an embodiment of an inventive sprinkling apparatus.
Figure 2:
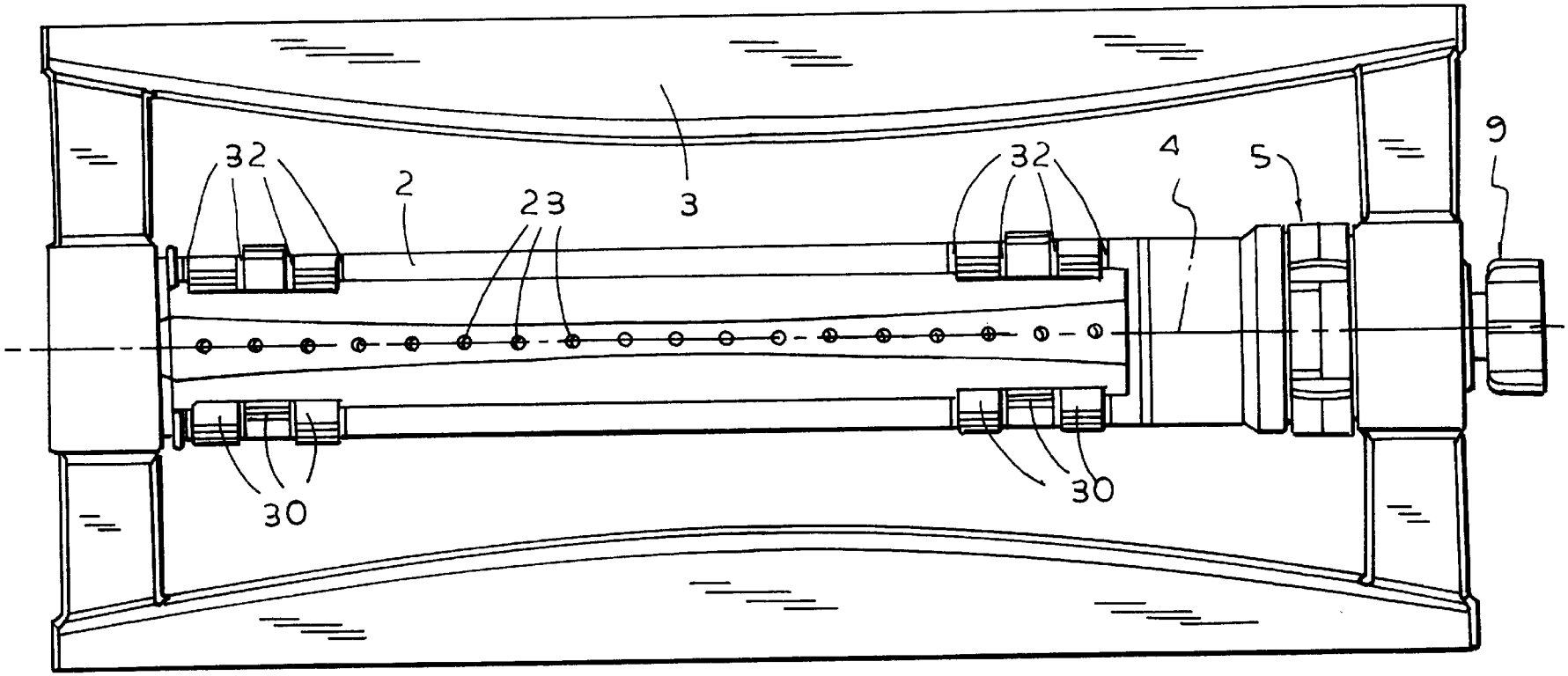
FIG. 2 is a plan view of a sprinkler casing of the type shown in FIG. 1, which is pivotably mounted about its longitudinal axis in a base of the sprinkling apparatus.

FIG. 1 shows a longitudinal section along a vertical plane through an embodiment of a sprinkling apparatus 1 constructed as a square sprinkler. A cross-sectionally substantially round, top-flattened, tubular plastic sprinkler casing 2 (FIG. 3) is mounted so as to rotate about its longitudinal axis 4 in a base 3 visible in FIG. 2 and is reciprocatable about the longitudinal axis 4 by means of a not shown, water-operated drive 5. On the drive side the sprinkler 1 can be connected by means of a screw coupling 9 and a not shown hose or the like to a pump or directly to the water mains.

On the top of the sprinkler casing 2, also known as a nozzle box, is provided a nozzle arrangement 6 in the form of a straight nozzle row with eighteen substantially equidistantly spaced single nozzles 7 arranged in the longitudinal direction of the nozzle row. Each of the nozzles 7 is constructed as a single jet nozzle for delivering a bundled water jet in a delivery direction 8 designated for some of the nozzles by a broken line. Corresponding to the fan-like, relative tilting of adjacent delivery directions with respect to one another, the square sprinkler 1 delivers a divergent jet fan, if water is passed under pressure into the interior of the casing 2 from a not shown liquid supply, e.g. the water mains.

The nozzles 7 of the nozzle arrangement 6 are constructed on a continuous, strip-like nozzle arrangement body or nozzle strip 10 of rubber-like or similar, elastically flexible material in one piece with the strip. Each of the single nozzles formed completely and homogeneously from the elastic material shown in FIG. 3 has a nozzle inlet 11 widening in funnel-shaped manner towards the interior of the sprinkler casing or narrowing in the flow direction, which, around its inner circumference 4, has radially inwardly directed, axial guide webs 12 for low-turbulence water guidance. Subsequently the nozzle duct 14 extending between the nozzle inlet 11 and nozzle outlet 13 is provided roughly centrally between inlet and outlet with a portion 15 directly connected to the upper end of the guide webs and which has an internal cross-section substantially conically tapering to the nozzle outlet, which gently passes into an outlet-side outer portion 16 with a substantially cylindrical internal cross-section. The cylindrical internal cross-section in the outer area 16 is appropriately small compared with the nozzle duct length and is e.g. between approximately 5 and 20 or 30% of said length. The outer contour of the nozzle tapers from the upper portion of the guide webs 12 roughly conically and with slightly concavely inwardly curved outer faces to an outlet-side, roughly cylindrical external cross-section. This shaping of the nozzle made from elastically flexible, rubber-like material ensures that the wall thickness of the elastically flexible wall surrounding the nozzle duct and arranged in rotationally symmetrical manner to the nozzle axis 17 is at its thinnest in the central portion 15 above the guide webs 12 and below the cylindrical outer portion 16 and increases continuously towards the two open ends.

As a result of the particularly thin-walled central portion 15, in the elongated path of the nozzle duct 14 in the direction of the water flow between nozzle inlet 11 and nozzle outlet 13 a cross-section change portion 14 is formed, where as a result of force action transversely to the longitudinal direction of the nozzle duct, a disconnection or untieing thereof occurs up to its complete sealing. On disconnection or untieing in the thin-walled central area, both the nozzle outlet area 16 and the nozzle inlet area 11, which are both thicker than the cross-section change portion 15, substantially maintain their shape.

In the vicinity of the nozzle inlets 11, the nozzles are inserted in self-holding and self-sealing manner from the interior of the sprinkler casing 2 into a row of inlet through openings 20 on the flattened top of the casing 2 by means of barb-like, annular projections 21. Thus, the tubular casing 2 forms a first holding or retaining device for the stable holding of the nozzle inlet areas 11. For the stable holding of both outer and inner, substantially cylindrical nozzle outlet areas, a second holding device detachably fixed to the sprinkler casing 2 and constructed as a straight cover bar 22 is provided and which in the cross-section shown in FIG. 3 is circular segmental with a planar, flattened top, in which is provided a row of outlet through openings 23 for the stable holding of the nozzle outlets. Each of the outlet through openings 23, one being provided for each nozzle, is substantially cylindrical and its diameter is so adapted to the external diameter of the nozzle outlet area 16, that the latter is held in substantially clearance-free manner in the associated outlet through opening. As can be seen in FIG. 1, the cylinder axes of the guide holes or outlet through openings 23 are not parallel to one another, but are instead tilted against one another in a plane corresponding to the sectional plane of FIG. 1, so that their longitudinal axes determining the delivery direction 8 of the nozzles tend to move away in fan-like manner from the casing 2.

This construction permits a particularly simple installation of a sprinkler with a fan-like sprinkling pattern. On inserting the nozzle strip in the sprinkler casing, the nozzles of the strip 10 are initially all identically oriented, i.e. their outlet portions 16 can be parallel to one another. Only in the installed state, as a result of bending round the nozzle outlet area 16, are different, fanned out jet directions obtained. In the represented embodiment this is brought about in that the guide holes 23 of the cover bar 22 having a fan-like configuration deflect the nozzle outlet areas 16 into the desired direction. The outlet through openings 23 have inwardly facing inlet sides or insertion portions 24, which are equidistantly arranged along the nozzle row, like the actual nozzles and which in the case of correct axial arrangement of casing 2 and cover bar 22 are aligned with the outlet sides 25 of the inlet through openings 20. Thus, on installation, the cover bar 22 can be placed on the nozzle row from above, the nozzles collectively entering the insertion portions 24 or guide holes 23, without having to be individually threaded in. On further engaging the cover bar onto the nozzles in the direction of the nozzle box 2, the nozzle outlet portions 16 slide into the guide holes 23 and are thereby elastically deflected. For the preferably detachable fixing of the cover bar 22 to the top of the nozzle box 2, it is possible to use all suitable connecting means, e.g. screws or the like. It is particularly installation-favourable to have a snap-action connection which can be produced without using tools, in which e.g. on the flattened top of the sprinkler casing 2 are provided longitudinally directed holding webs with outwardly directed holding noses which engage in snapping manner on pressing on behind inwardly directed holding noses on downwardly directed connecting webs of the cover bar 22. By interchanging cover bars with different guide hole inclinations, it is possible to modify the fundamental sprinkling pattern of the sprinkler.

By the positional fixing of the nozzle inlet portions 11 in the openings 20 of the sprinkler casing 2 following installation and the nozzle outlets 11 in the guide holes 23 of the cover bar 22 in spaced manner above the sprinkler casing top, the central portions 15 of the nozzles are freely accessible from a direction at right angles to the nozzle axis 17, but cannot laterally give way in the case of a force being exerted at right angles to the nozzle axis.

In the represented embodiment the delivery of liquid from an individual nozzle can be adjusted by means of an adjusting device, which has a cross-section change means in the form of a clamping slider 30 acting on the cross-section change portion 15. In the embodiment shown in FIGS. 1 and 2 only three marginal nozzles can be shut down by sliders 30, whereas the central nozzles always remain in operation. For other nozzles or nozzle groups, particularly for all the nozzles of the sprinkling apparatus, it is possible to provide such clamping sliders or the like and in particular identically acting cross-section change means.

Each of the sliders, whereof one is shown in longitudinal section in FIG. 3, in plan view in FIG. 4 and in cross-section in FIG. 5, is manually displaceable parallel to a clamping direction 31, which is perpendicular to the longitudinal direction of the nozzle row 6 and is guided between a pair of guide webs 32, which, as is visible in FIG. 1, is constructed in one piece with the sprinkler casing 2 and in each case arranged between two adjacent inlet through openings. In the represented embodiment a slider, as visible in FIGS. 3, 4 and 5, is in the form of a parallel-bounded circular arc portion, being guided in lateral clearance-free manner between its associated guide webs 22 and is displaceably in slidably mounted manner along a circumferential segment of the nozzle box that a displacement in the clamping direction corresponds to a pivoting of the clamping slider about the central axis 4 of the box. Other configurations are also possible, particularly a planar sliding of a clamping slider in a plane perpendicular to the longitudinal direction of the nozzle row and to the nozzle ducts 14. On the outside of their end portions the sliders are provided with a grip-favourable transverse fin system 33, by means of which a clamping slider can be pivoted or moved in sensitive manner parallel to the clamping direction by means of e.g. the thumb and index or middle finger of a spread open hand.

Each of the clamping sliders has a tear-shaped clamping opening 34 enclosing the cross-section change portion 15 of the associated nozzle and whose inside diameter at right angles to the clamping direction or parallel to the axis 4 zonally changes in the clamping direction. In this embodiment, the clamping opening has a roughly pear-shaped, wide opening portion 35, whose inside diameter is substantially the same or slightly larger than the diameter of the associated nozzle in the vicinity of the cross-section change portion 15. If, as shown in FIG. 3, the clamping slider is set in such a way that the nozzle, in the vicinity of the wide opening portion, projects through the clamping opening, the nozzle is substantially free from external clamping forces and the elastically flexibly defined cross-section change portion assumes its relieved position with maximum through cross-section of the nozzle duct. To the wide opening portion 35 is connected by means of a continuously narrowing intermediate portion 36, a clamping portion 37 adjacent in the clamping direction and which in the embodiment is bounded on the parallel side and perpendicularly to the clamping direction has an inside diameter which is slightly less than twice the nozzle wall thickness in the vicinity of the cross-section change portion 15. As a result of this dimensioning, on displacing the clamping slide in such a way that the cross-section change portion passes into the clamping portion 37, the nozzle duct is compressed up to the completely liquid-tight disconnection from diametrically opposing sides, so that the liquid flow through the nozzle in the clamping position is reliably interrupted. FIG. 5 shows that the opening edges of the clamping opening 34 both on the top facing the cover bar and on the bottom facing the casing 2 are smoothly rounded, so that the nozzle body material, even in the case of a multiple actuation of the clamping slider, is not damaged by the latter.

During installation, the clamping slides with the wide opening portion 35 are placed over the nozzles between the guide webs 32 and subsequently the cover bar 22 is shoved onto the nozzle outlets and locked to the nozzle box. The clamping slides then project through lateral guide openings 29 of the cover bar and are secured by the latter against dropping out.

The invention more particularly permits the described, very rapid and simply assemblable sprinkling apparatus for square sprinkling surfaces, in which the nozzles, at least in a preferably central portion between the nozzle inlet 11 and nozzle outlet 13, are constructed as rubber-like water guidance ducts, which can be disconnected by force action transversely to the water flow direction, without it being necessary to seal the nozzle inlet and/or nozzle outlet by separate blocking devices. The nozzle inlet and outlet can have an optimum design for their function and maintain their shape and function also during the disconnection process, during which the passage cross-section of the nozzle can be reduced continuously, optionally to zero. The adjustability of the sprinkling pattern of sprinkling apparatuses according to the invention is in particular not impaired by the liming of nozzles, because the central nozzle portion 15 used for blocking purposes is not very susceptible to liming, because it is less frequently exposed to the ambient air than the vicinity of the nozzle outlet, and because during each disconnection process optionally adhering deposits scale off the compressed wall and can be flushed out of the nozzle. A permanently operable sprinkling apparatus is provided, whose sprinkling pattern can be adjusted with wide variations.

The invention has been explained relative to the example of a square sprinkler. However, in the case of a corresponding design of the cooperating elements, it can also be used for circular sprinklers and sprinkling apparatuses for differently shaped sprinkling surfaces.

We claim:

1. A method for adjusting a sprinkling pattern of a sprinkling apparatus, the sprinkling apparatus having a nozzle arrangement which is connectable to a supply for liquid, the nozzle arrangement having a plurality of nozzles, wherein each nozzle has a nozzle inlet, which is connected by means of a nozzle duct to a nozzle outlet and wherein each nozzle has a nozzle duct cross-section and at least one nozzle has a cross-section change portion, and wherein for adjusting the sprinkling pattern the liquid flow through at least one nozzle is influenced by modifying the nozzle duct cross-section of the nozzle in at least one cross-section change portion.

2. A method according to claim 1, wherein the cross-section change portion is positioned between the nozzle inlet and the nozzle outlet.

3. A method according to claim 1, wherein the nozzle duct cross-section in the vicinity of at least one of the nozzle inlet and the nozzle outlet remains substantially unchanged during the adjusting.

4. A method according to claim 1, wherein the nozzle duct cross-section is continuously changed during adjustment up to one of a liquid-tight shutting off of the nozzle duct and a maximum passage cross-section.

5. A method according to claim 1, wherein the cross-section change portion is compressed by force action transversely to the nozzle duct during adjustment, whereby a cross-sectional change of the nozzle duct cross-section is obtained.

6. A method according to claim 5, wherein the cross-section change portion, during adjustment, is influenced symmetrically to the nozzle duct from two diametrically opposite directions to the nozzle duct.

7. A sprinkling apparatus comprising:

at least one nozzle arrangement connectable to a supply for liquid, the nozzle arrangement having a plurality of nozzles, wherein each nozzle has a nozzle inlet, which is connected by means of a nozzle duct to a nozzle outlet and;

an adjusting device for selectively setting the liquid delivery of one of individual nozzles and nozzle groups of the nozzle arrangement, wherein at least one nozzle has at least one cross-section change portion, in which the nozzle duct cross-section is variable and wherein the adjusting device comprises cross-section change means acting on the cross-section change portion.

8. The sprinkling apparatus according to claim 7, wherein the sprinkling apparatus is a square sprinkler.

9. The sprinkling apparatus according to claim 7, wherein the nozzle arrangement is a single linear nozzle row.

10. The sprinkling apparatus according to claim 7, wherein the cross-section change portion of a nozzle is positioned between the nozzle inlet and the nozzle outlet.

11. The sprinkling apparatus according to claim 7, further comprising a first holding device with inlet through openings for the stable holding of the nozzle inlets and a second holding device with outlet through openings arranged in spaced manner from the first holding device for the stable holding of the nozzle outlets.

12. The sprinkling apparatus according to claim 11, wherein the sprinkling apparatus has a liquid supply casing and wherein the first holding device is formed by the liquid supply casing.

13. The sprinkling apparatus according to claim 11, wherein the sprinkling apparatus has a liquid supply casing and wherein the second holding device is formed by a holder fixed to the liquid supply casing.

14. The sprinkling apparatus according to claim 13, wherein the holder has a ledge-like form.

15. The sprinkling apparatus according to claim 11, wherein the outlet through openings have inlet sides and the inlet through openings have oulets sides and wherein the inlet sides of the outlet through openings are aligned with the outlet sides of the inlet through openings.

16. The sprinkling apparatus according to claim 11, wherein the outlet through openings and the inlet through openings have opening axes and wherein the opening axis of the outlet through openings are arranged at an inclination angle to the opening axis of the inlet through openings.

17. The sprinkling apparatus according to claim 11, wherein the outlet through openings are tilted in fan-like manner against one another.

18. The sprinkling apparatus according to claim 7, wherein a nozzle has a wall made from elastically flexible material at least in the vicinity of the cross-section change portion of the nozzle.

19. The sprinkling apparatus according to claim 18, wherein the wall made from elastically flexible material completely surrounds the nozzle duct at least in the cross-section change portion.

20. The sprinkling apparatus according to claim 7, wherein a nozzle has a nozzle body made of elastically flexible material, on which is formed the nozzle inlet, the nozzle outlet, the nozzle duct and the cross-section change portion.

21. The sprinkling apparatus according to claim 20, wherein the nozzle body is made of one piece of elastically flexible material.

22. The sprinkling apparatus according to claim 7, wherein the nozzle arrangement comprises at least one continuous nozzle arrangement body of elastically flexible material, on which are arranged nozzle bodies of the nozzle arrangement.

23. The sprinkling apparatus according to claim 22, wherein the nozzle bodies are arranged in one piece with the nozzle arrangement body.

24. The sprinkling apparatus according to claim 7, wherein the nozzle inlet is widened in funnel-shaped manner to the inlet side and has inwardly directed, axial guide webs for low turbulence water guidance.

25. The sprinkling apparatus according to claim 7, wherein the nozzle duct between the nozzle inlet and nozzle outlet has a portion with an inside cross-section continuously decreasing to the nozzle outlet.

26. The sprinkling apparatus according to claim 25, wherein the portion with continuously decreasing inside cross-section passes into an outlet-side outer portion with a substantially cylindrical inner cross-section.

27. The sprinkling apparatus according to claim 7, wherein a nozzle has an external diameter which at least zonally tapers conically from the nozzle inlet to the nozzle outlet.

28. The sprinkling apparatus according to claim 7, wherein the nozzle has an outlet-side outlet portion with a substantially cylindrical inner cross-section and a nozzle inlet portion with guide webs and wherein the cross-section change portion is positioned between the outlet-side outer portion and the guide webs.

29. The sprinkling apparatus according to claim 7, wherein, on either side of the cross-section change portion, a nozzle has a greater wall thickness than the wall thickness in the cross-section change portion.

30. The sprinkling apparatus according to claim 29, wherein the wall thickness of the nozzle continuously increases to either side of the cross-section change portion.

31. The sprinkling apparatus according to claim 7, wherein the cross-section change means have at least one squeezing device for squeezing a cross-section change portion of at least one nozzle, the nozzle being compressible accompanied by a cross-sectional reduction upon squeezing by the squeezing device in the cross-section change portion.

32. The sprinkling apparatus according to claim 7, wherein the cross-section change means for a nozzle comprise at least one clamping slider displaceable in a clamping direction transversely to the nozzle duct.

33. The sprinkling apparatus according to claim 32, wherein the clamping slider has a clamping opening enclosing the cross-section change portion and having an inside diameter which changes at least zonally parallel to the clamping direction.

34. The sprinkling apparatus according to claim 33, wherein the clamping opening has a wide opening portion with a cross-section substantially corresponding to the external diameter of the cross-section change portion in a relieved state, and at least one adjacent clamping portion aligned parallel to the clamping direction and having an inside diameter being smaller than the inside diameter of the wide opening portion.

35. The sprinkling apparatus according to claim 34, wherein between the opening portion and the clamping portion there is arranged a continuously tapering intermediate portion.

36. The sprinkling apparatus according to claim 7, wherein the nozzle arrangement comprises adjustable nozzles and wherein each of the adjustable nozzles is provided with a separately operable cross-section change means.

37. The sprinkling apparatus according to claim 36, wherein the cross-section change means is a clamping slider.

38. The sprinkling apparatus according to claim 36, wherein the cross-section change means is manually operable.

39. The sprinkling apparatus according to claim 7, wherein cross-sectional change means are only provided on some nozzles of the nozzle arrangement.

40. The sprinkling apparatus according to claim 7, wherein cross-section change means are only provided on marginal nozzles or nozzle groups of the nozzle arrangement.

41. The sprinkling apparatus according to claim 7, wherein the nozzle arrangement is a nozzle row and wherein a cross-section change means of the nozzle is moveable substantially perpendicular to the nozzle row.

* * * * *